United States Patent [19]

Hoffman

[11] Patent Number: 4,551,881

[45] Date of Patent: Nov. 12, 1985

[54] FRICTION BRAKE FOR A VERTICAL SLIDING WINDOW

[75] Inventor: Michael K. Hoffman, Cannon Falls, Minn.

[73] Assignee: Plastic Profiles, Inc., Cannon Falls, Minn.

[21] Appl. No.: 602,896

[22] Filed: Apr. 23, 1984

[51] Int. Cl.[4] ..... E05D 13/12

[52] U.S. Cl. ..... 16/199; 16/341; 49/415; 49/417; 188/67; 188/166

[58] Field of Search ..... 16/193, 197, 198, 199, 16/200, 341; 188/67, 166; 49/415, 417; 292/74

[56] References Cited

U.S. PATENT DOCUMENTS

| | | | |
|---|---|---|---|
| 2,613,093 | 10/1952 | Foresman | 16/197 X |
| 2,984,509 | 5/1961 | Kaufman et al. | 49/415 |
| 3,280,511 | 10/1966 | Johnson | 16/197 X |
| 3,466,806 | 9/1969 | Teggelaar et al. | 49/445 |
| 3,501,867 | 3/1970 | Scott | 16/193 X |
| 3,788,006 | 1/1974 | Teggelaar et al. | 16/193 X |

*Primary Examiner*—Fred Silverberg

*Attorney, Agent, or Firm*—Jacobson and Johnson

[57] ABSTRACT

A plastic liner is attached to the jamb of a vertical sliding window and has a continuous "U" channel with the channel opening facing the window opening and a block member slidingly engaged in the channel adapted to be coupled to the window sash and to one end of an elongated coil spring located in the channel which is attached at its other end to the liner. Primary frictional braking force is provided by a wing member inside the channel pushing against the block member so it rubs against a wall of the channel. The block member rides over a "T" shaped rail in the channel and carries a set screw which can be reached through the channel opening to be threaded through the block member into contact with the top surface of the rail member for manually adjusting the frictional braking force on the block member.

17 Claims, 7 Drawing Figures

FRICTION BRAKE FOR A VERTICAL SLIDING WINDOW

FIELD OF THE INVENTION

This invention is for use with vertical sliding windows. Generally these are double hung windows, that is, one-half of the window sash being in front of the other and each half independently slideable in its own track in the window jamb. In windows of this type the weight of the window sash must be balanced in some fashion so that the window will stay in position when partway opened or closed. In general, an elongated spring element is used in conjunction with the braking mechanism to provide the desired overall balancing effect.

DESCRIPTION OF THE PRIOR ART

The closest prior art is best exemplified in U.S. Pat. No. 3,466,806 dated Sept. 16, 1969 by Teggelaar, et al. titled "Balance Structure for Windows and the Like". The Teggelaar device comprises a jamb liner having an open channel or slot containing a braking unit which is attached to one end of an elongated coil spring also resting in the channel whose other end is attached to the window frame or casing. The braking unit is also coupled to a shoe which carries the weight of the window sash. The braking member is molded out of a hard, stiffly resilient and somewhat lubricious plastic material such as nylon and contains a leaf spring or some other type of resilient element to bias the rear wall of the braking unit against the surface of the channel in the jamb liner which faces the channel opening to provide the frictional braking force. An adjustment screw is provided to vary the force on the leaf spring if necessary.

SUMMARY

A preferred embodiment of the present invention utilizes a molded vertical jamb liner having a generally U shaped channel in which is engaged a slidable molded block member which is adapted to be coupled to the window sash. A somewhat elongated coil spring is also located in the channel and is physically attached at one end to the block member and at its other end to the jamb liner. The primary frictional braking force is provided by a wing member integrally formed as part of the jamb liner extending into the channel to provide a resilient force against the block member urging it toward a side of the channel to provide the frictional braking force. As a further feature a track is also integrally formed in the jamb liner channel area with the block member riding over the track. An adjustment screw is located in a threaded opening through the block member so it can be manually threaded to make contact with the track to adjust the frictional engagement of the block member in the channel in the event the frictional force provided by the wing member is inadequate because of wear or other reasons. The block member can be molded by continuous extrusion and then be cut into individual pieces to any desired length. This makes it considerably less expensive to manufacture when compared to previously used braking members such as described in the Teggelaar, et al. patent which have to be pressure molded individually. Also, the braking block member of this invention is integrally formed in one operation and does not need a metal leaf spring inserted as is the case with the Teggelaar device.

BRIEF DESCRIPTION OF THE DRAWING

.

DESCRIPTION OF THE PREFERRED EMBODIMENT

Figure 1:
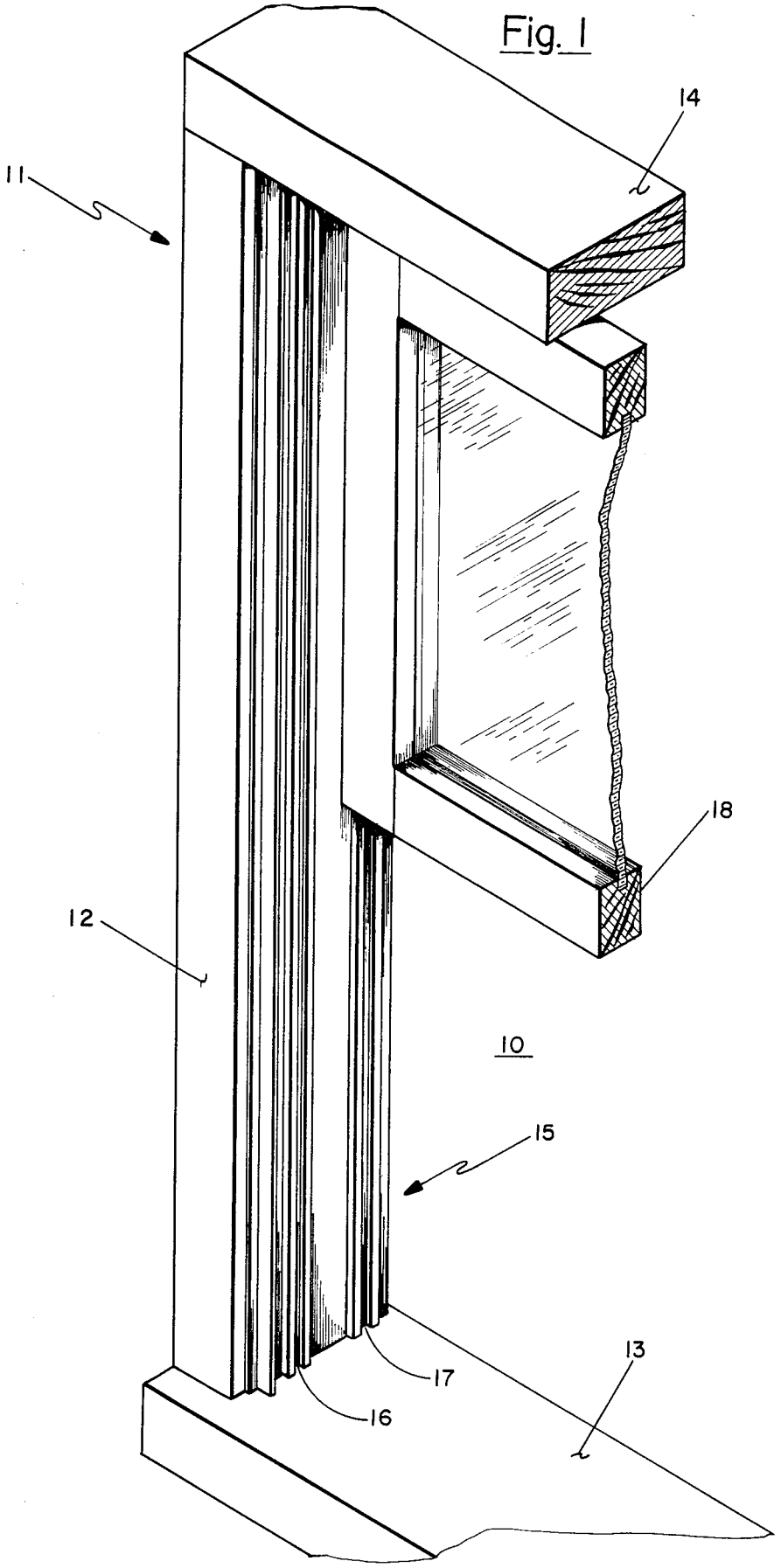
FIG. 1 is a fragmented perspective view of the general layout of a window casing or frame in which the instant invention is utilized.

In a typical home installation, for example, a window opening 10 is defined by a casing or frame 11, usually made of wood, having parallel vertical side jambs 12 (only one shown), a lower horizontal sill 13 and an upper horizontal header 14. On the inside of the jamb 12 is a jamb liner generally designated by reference numeral 15 which may be made out of plastic and serves the dual purpose of providing guides for the sliding window sash 18 and for providing weather stripping around the edges of the installed windows. In a typical installation for double hung windows, the jamb liner 15 has a pair of parallel channels 16 and 17 and suitable insulation material having some compressible characteristics is inserted between the jamb lining 15 and the jamb 12. Typically, this may be foam plastic or the like. This material not only provides insulation around the jamb liner 15 but because of its compressibility also permits some degree of lateral movement for removing and installing the window sash. This is not considered a part of the instant invention however.

In general, each half of the double hung windows operates in the same fashion so the description of the invention will only be made with respect to one sliding window and it should be understood that the same description will apply similarly to the other window. Also, it should be understood that each side of each window must operate in the same fashion but the invention will only be described with respect to one side.

Figure 2:
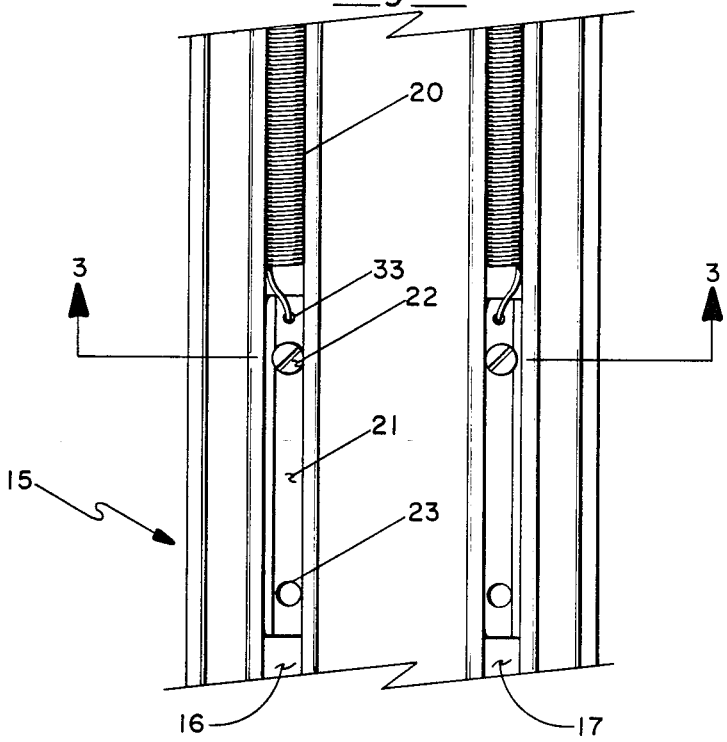
FIG. 2 is a fragmented partial view showing a preferred embodiment of the invention as it would appear when installed in a window frame.

FIG. 2 shows a section of one part of the jamb liner 15 having "U" shaped channels 16 and 17 and suitable grooves in which the window sash slides in its vertical travel. Located in "U" channel 16 is a somewhat elongated coil spring 20 having one end attached in some convenient fashion, not shown, to the jamb liner 15 and having its other end attached to opening 33 in braking block member 21 which slides up and down in channel 16. The head of an adjustment screw 22 which is threaded through the block member 21 is accessible from inside the window opening and the block member 21 also has an aperture 23 to accept a pin (not shown) which is attached to the window sash when the window sash is assembled into the frame.

Figure 3:
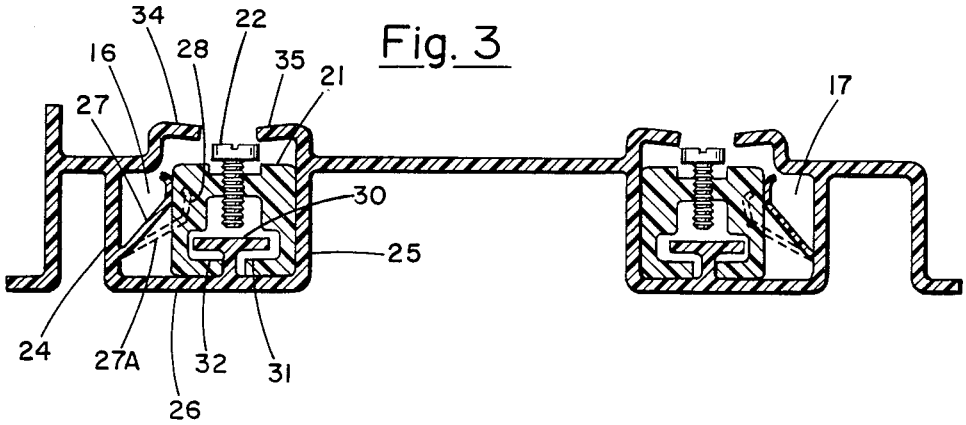
FIG. 3 is a horizontal section view of a preferred embodiment of the invention as viewed along 3—3 of FIG. 2.
Figure 4:
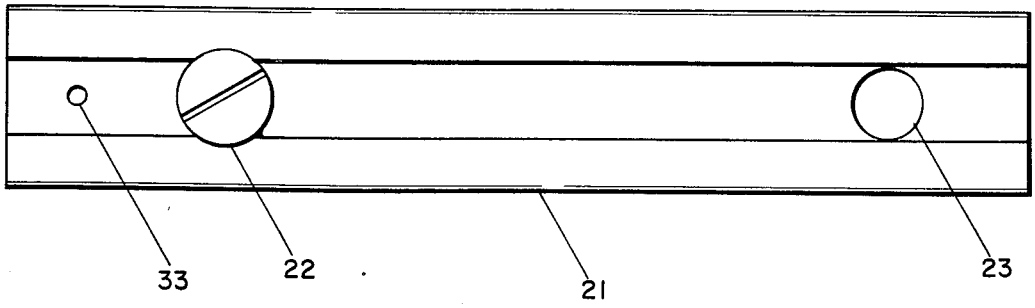
FIG. 4 is a front plan view of a braking block member constructed according to the teachings of the invention.
Figure 5:
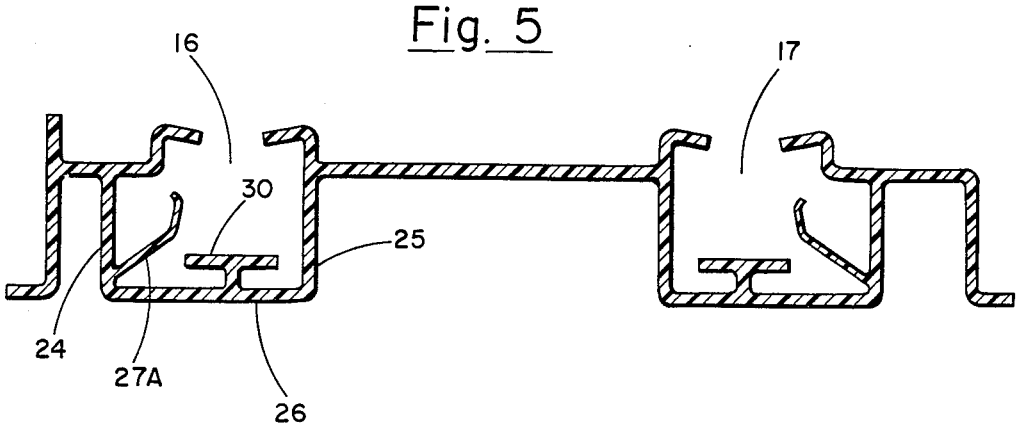
FIG. 5 is a horizontal section view similar to FIG. 3 without the braking member or spring.

As seen more clearly in FIG. 3, the "U" channel 16 of jamb liner 15 is defined by front and back walls 24 and 25 and side wall 26 which parallels the window frame jamb and has an opening or mouth facing the opening in the window frame between a pair of inward and slightly downward sloping ridges or lips 34 and 35. Extending inward from its attachment to wall 24 is an arcuate wing member 27. The wing member is attached at one end to wall 24 and angles inwardly and has a somewhat spoon shape in cross section with a flattened area at 28. Extending inward from wall 26 is a T shaped rail member 30. Braking block member 21 has a pair of skirts generally designated 31 and 32 which extend around the outer edges of the rail member 30 so that the block member slides in the channel 16 over the rail member 30. With block member 21 removed from the channel 16, the wing member is positioned as shown by 27*a* in FIG. 5 and by the dashed line configuration 27*a* in FIG. 3. With block member 21 inserted because of its resiliency wing member 27 applies pressure against block member 21 urging it toward the opposite wall 25. As shown in the FIG. 3 embodiment, one side of block member 21 is forced by wing member 27 into contact with the inside surface of wall 25. In general there is still a gap between the track 30 and the skirts 31 and 32 of block 21 but any contact is just incidental. Block 21 has a first aperture 23 to accept a pin (not shown) which extends outward from the window sash so that the window sash will then ride in the channel 16 along with the braking member 21 with the weight of the window being carried by the braking member 21. An adjustment screw 22 is threaded through braking member 21 and extends toward the exposed surface of rail member 30. For manual adjustment, when needed, the head of screw 22 is accessible through the opening into channel 16. FIG. 4 gives another view of the braking block member 21 showing the aperture 23 for accepting the pin from the window sash, the adjustment screw 22 and another opening 33 in which one end of spring 20 may be inserted. From the views shown in FIGS. 3 and 4 it can be observed that block member 21 can be manufactured by an extrusion process in which a continuous length of suitable plastic material can be extruded having the necessary cross-section profile as described and shown in the drawings and then individual pieces can be cut to any desired length as required for any particular installation. The various openings 22 and 23 and 33 can then be machined or punched or otherwise formed in some suitable and convenient fashion.

In operation, the braking block member 21 is slipped into channel 16 and coil spring 20 is inserted with the latter having one end conveniently attached to the jamb liner 15 and the other end attached to braking block 21 such as by being inserted into opening 33. In a conventional fashion a window sash 18 has a pin (not shown) extending out from it which is inserted into the aperture 23. As mentioned earlier, both sides of the window sash usually have pins which are inserted into the openings in their respective braking members in the opposite facing channels on each side of the jamb liner 15. The compressibility of insulation behind the jamb liner, the unique construction of the pin in the window sash in some instances and in some cases design of the aperture 23 permit the window sashes to be easily detached from the brake member 21 and reinserted as necessary. The manner of accomplishing this is not considered a part of the instant invention and will not be described further. In any event, with the pin inserted in the aperture 23 the weight of the window sash is then being carried by the block member 21 and as the window is slid up and down for opening and closing spring 20 elongates or compresses to counteract in part the weight of the window sash. For additional weight balancing the wing member 27 in channel 16 bearing against brake member 21 pushes it against the inner surface of wall 25 of channel 16 to provide a frictional force. In general, the combination of the spring along with the frictional force provided by the braking member 21 is suitable to balance the weight of the window sash so that it can be raised and lowered and set in intermediate positions within the window frame.

In time there may be some wear of the channel or wing member 27 may lose its resiliency or some other factor may cause reduction of the braking force by block member 21. If this should happen, then adjustment screw 22 can be threaded through block member 21 to make contact with the top surface of rail 30 thereby drawing up the block member 21 so that the skirts 31 and 32 then make contact with the underside of rail member 30 and provide some additional frictional braking force to compensate for the reduction of the braking action.

Figure 6:
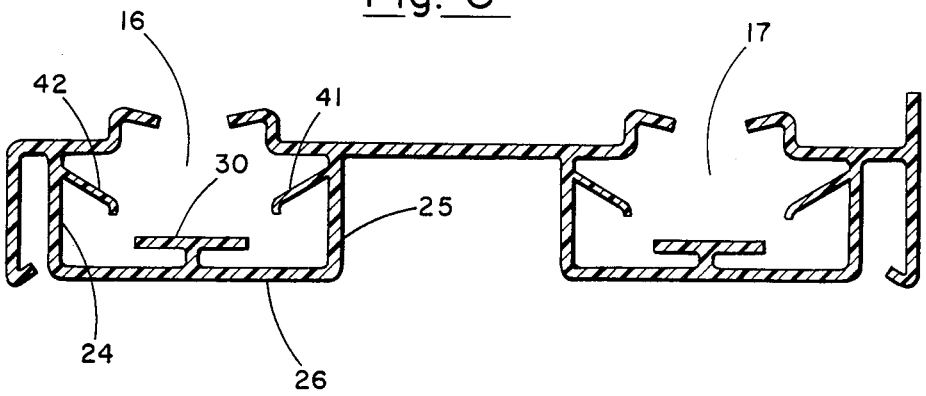
FIG. 6 is a horizontal section view of an alternate embodiment of the invention.

A modification of the previously described embodiment of the invention in FIG. 6. This embodiment utilizes two wing members 42 and 41 extending inwardly in channel 16 from walls 24 and 25 both of which function similarly to wing member 27. In this instance, however, the frictional force is provided by the block member 21 in contact with the surfaces of wing member 42 and 41 instead of the contact with the side wall of the channel. In all other respects the device operates in the same fashion and would also include an adjustment screw 22 to compensate for loss of frictional braking force or to add further braking force if necessary and would operate and be used in the fashion as described earlier.

It should also be noted that the instant invention as described can be utilized with jamb liner 15 having various profiles for adaptation to different types of sliding windows. The only necessary requirement is that it include a channel with a sliding braking block member and a suitable wing member extending from the inner wall of the channel making frictional engagement to provide a braking force in combination with a spring to balance against the weight of the window sash.

Figure 7:
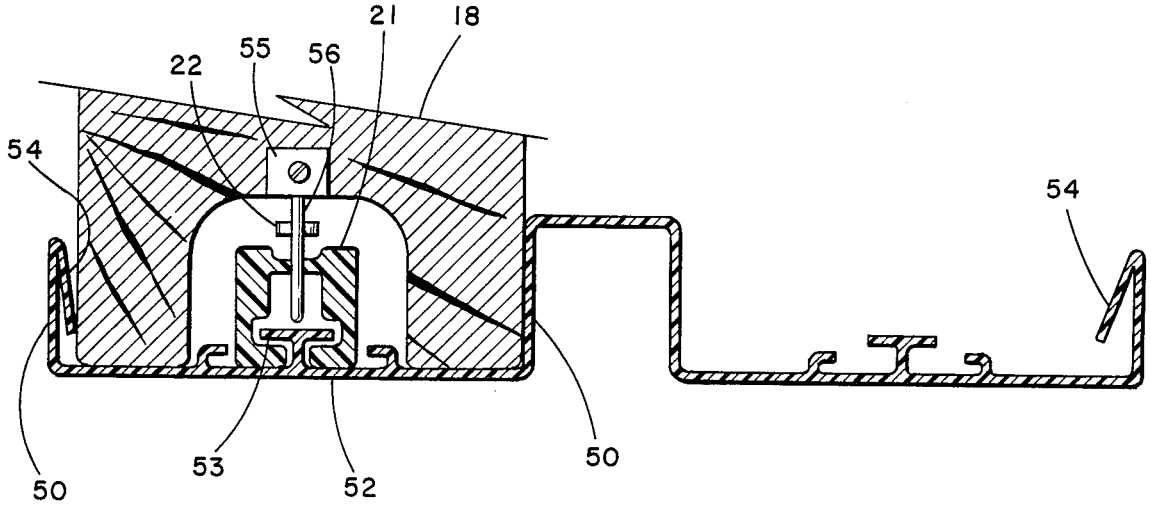
FIG. 7 is an end view illustrating another embodiment of the invention.

In another embodiment of the invention illustrated in FIG. 7, the channel is defined by parallel spaced-apart end walls 50 and 51 and a side wall 52 and contains a track member 53 having a T cross section similar to the other embodiments which extends into the channel from side wall 52. In this embodiment the window sash 18 as well as the block member 21 are slidably engaged in the channel. A wing member 54 extends into the channel from end wall 50 and presses against the side of the sash 18 urging it into contact with the opposite end wall 51 to provide frictional braking force. The sash has a bracket 55 which is recessed into one end of the sash and extending from the bracket toward block member 21 is a pin 56 which is inserted into the hole or aperture 23 of block 21. An adjustment screw 22 for adding frictional force if necessary in the same manner as described with respect to the other embodiments is also provided. Access to screw 22 would be obtained by unscrewing the bracket 55 so that window sash 18 could be moved without block member 21 moving along with it thereby making the head of adjustment screw 22 accessible from the window frame opening. The screw 22 can then be adjusted as necessary and the sash then slid back into place so bracket 55 can be reattached. The right hand side of FIG. 7 is an illustration of the channel without the sash inserted to show how far wing member 54 may resiliently extend into the channel.

I claim:

1. For braking a vertically sliding window:

a window jamb liner attached to a vertical side jamb of a window casing, said jamb liner having an elongated "U" shaped channel defined by a channel opening, a side wall located opposite the channel opening and parallel front and back end walls;

a block member slidably engaged in said jamb liner channel;

an elongated resilient wing member unitarily formed with an end wall and extending into the channel along the entire length of the channel from the end wall for contacing said block member and urging said block member toward the other end wall for continuously providing a frictional braking force on said block member while said block member is in said channel; and means on said block member for releasably engaging a window sash.

2. The invention as described in claim 1 wherein the wing member is curved at its distal edge to make surface-to-surface contact with said block member.

3. The invention as described in claim 1 including further means coupled to said block member for adjustably changing frictional braking force on said block member.

4. Th invention as described in claim 3 wherein said means for adjustably changing the braking force comprises:

a continuous track member integrally formed with said jamb liner extending into said channel from the side wall;

said block member riding over said track member and having a skirt extending at least part way around the edges of the track member; and means attached to said block member for adjustably bearing on said track member to vary the frictional braking force on said block member.

5. The invention as described in claim 4 wherein said means for adjustably bearing on said track member comprises:

an aperture through said block member; and a member engaged in said aperture for adjustably bearing on the track member.

6. The invention as described in claim 5 wherein said aperture is threaded and said member is a screw threadably engaged in said aperture with the screw head accessible through the channel opening for adjustably moving the screw against a surface of the track member.

7. The invention as described in claim 6 wherein said screw is movable against the track member for producing a frictional braking force between the block member and the track member.

8. The invention as described in claim 4 wherein said track member is T shaped in cross section with the end of the leg of the T attached to the side wall.

9. The invention as in claim 1 wherein said means for engaging a window sash comprises an opening in said block member facing the channel opening for receiving a pin attached to a window sash.

10. The invention as in claim 9 further including an elongated spring member in the channel attached at one end to the jamb liner and attached to the block member at its other end.

11. For braking a vertically sliding window:

a window jamb liner attached to a vertical side jamb of a window casing, said jamb liner having an elongated "U" shaped channel having parallel front and back end walls, an opening facing the window casing opening and a side wall parallel to the window casing jamb;

a block member and a sash member releasably coupled together slidably engaged in said channel;

an elongated resilient wing member unitarily formed with an end wall and extending into the channel along the entire length of the channel from the end wall for contacting said block member to continuously provide a frictional braking force against the coupled sash and block members; and further means coupled to said block member for adjusting the braking force on said coupled sash and block members.

12. The invention as described in claim 11 wherein said means for adjusting the braking force comprises:

a continuous track member integrally formed with said jamb liner extending into said channel from the side wall;

said block member riding over said track member and having a skirt extending at least part way around the edges of the track member; and means attached to said block member for adjustably bearing on said track member to vary the frictional braking force on said block member.

13. The invention as described in claim 12 wherein said means for adjustably bearing on said track member comprises:

an aperture through said block member; and a member engaged in said aperture for adjustably bearing on the track member.

14. The invention as described in claim 13 wherein said aperture is threaded and said member is a screw threadably engaged in said aperture with the screw head accessible through the channel opening for adjustably moving the screw against a surface of the track member.

15. The invention as described in claim 14 wherein said screw is movable against the track member for producing a frictional braking force between the block member and the track member.

16. The invention as described in claim 12 wherein said track member is T shaped in cross section with the end of the leg of the T attached to the side wall.

17. The invention as described in claim 11 further including an elongated spring member in the channel attached at one end to the jamb liner and coupled to the sash member at its other end.

* * * * *